US007501044B2

(12) United States Patent
Hikida et al.

(10) Patent No.: US 7,501,044 B2
(45) Date of Patent: Mar. 10, 2009

(54) PAPER MAKING ELASTIC BELT

(75) Inventors: Takahisa Hikida, Yawata (JP); Keiji Nakagawa, Kyoto (JP); Hiroyuki Yasukawa, Tochigi (JP)

(73) Assignee: Yamauchi Corporation, Osaka (JP)

( * ) Notice: Subject to any disclaimer, the term of this patent is extended or adjusted under 35 U.S.C. 154(b) by 448 days.

(21) Appl. No.: 11/289,236

(22) Filed: Nov. 29, 2005

(65) Prior Publication Data

US 2006/0113052 A1 Jun. 1, 2006

(30) Foreign Application Priority Data

Nov. 30, 2004 (JP) ..... 2004-346643

(51) Int. Cl.
*D21F 3/00* (2006.01)

(52) U.S. Cl. ..... 162/358.4; 162/901; 264/284

(58) Field of Classification Search ..... 162/117, 162/306, 348, 358.2, 358.4, 361, 362, 900–904; 264/284, 145, 154–156, 162
See application file for complete search history.

(56) References Cited

U.S. PATENT DOCUMENTS

| | | | | |
|---|---|---|---|---|
| 4,559,258 | A | 12/1985 | Kiuchi | |
| 4,944,820 | A * | 7/1990 | McCarten | 156/154 |
| 5,152,874 | A * | 10/1992 | Keller | 162/358.4 |
| 5,543,015 | A | 8/1996 | Jermo | |
| 5,965,208 | A * | 10/1999 | Fagerholm et al. | 427/428.21 |
| 6,296,738 | B1 * | 10/2001 | Ishii | 162/358.4 |
| 6,425,580 | B1 * | 7/2002 | Yaneda | 271/276 |
| 6,743,339 | B1 * | 6/2004 | Nilsson et al. | 162/358.2 |
| 7,128,811 | B2 * | 10/2006 | Watanabe | 162/358.4 |
| 2002/0060042 | A1 * | 5/2002 | Klerelid et al. | 162/358.1 |
| 2004/0154776 | A1 | 8/2004 | Inoue | |
| 2005/0274475 | A1 | 12/2005 | Hikida | |

FOREIGN PATENT DOCUMENTS

| | | |
|---|---|---|
| JP | 3130488 | 6/1991 |
| JP | 3749256 B2 | 8/1996 |
| JP | 2001098484 | 4/2001 |
| JP | 2002220789 | 8/2002 |
| JP | 2002327389 | 11/2002 |
| JP | 2003064590 | 3/2003 |
| JP | 2003306883 | 12/2005 |
| KR | 2003-0064782 | 8/2003 |

* cited by examiner

*Primary Examiner*—Eric Hug
(74) *Attorney, Agent, or Firm*—Ditthavong Mori & Steiner, P.C.

(57) ABSTRACT

A paper making elastic belt has a drainage channels in a surface. A surface roughness of a wall of the drainage channel is not more than 2.0 μm in arithmetic average roughness (Ra).

18 Claims, 2 Drawing Sheets

PAPER MAKING ELASTIC BELT

BACKGROUND OF THE INVENTION

1. Field of the Invention

The present invention relates to a paper making elastic belt used for pressing and dehydrating wet web in a field of a paper industry and the like, and more particularly, relates to a paper making elastic belt having a drainage channels in its surface.

2. Description of the Background Art

General required characteristics for the paper making elastic belt such as a shoe press belt includes strength, crack resistance, abrasion resistance, flexibility, impermeability to water, oil, gas and the like. As a material comprising the above characteristics, polyurethane provided by reacting urethane prepolymer with a curing agent is used in general.

In a paper making technique, it is known that many drainage channels are provided in an outer surface of the elastic belt along a travel direction of the wet web in order to drain water extracted from pressed wet web. For example, U.S. Pat. No. 4,559,258 discloses an elastic belt of a paper making machine comprising such drainage channels.

FIG. 4 is a sectional view showing a paper making elastic belt 1 comprising many drainage channels 2. Conventionally, in order to avoid leaving traces of the channels on the wet web, a channel width of the paper making elastic belt 1 is made small. The channel width is 0.6 to 1.5 mm in general.

Other required characteristics for the paper making elastic belt 1 having drainage channels 2 in its surface includes a drainage property in which water extracted from the wet web is immediately drained from the channel 2 of the belt 1 to the outside. If the water in the channel 2 is not drained during one rotation of the belt 1 which is rotating at high speed, the wet web becomes wet again and a property of squeezing out water from the wet web is lowered.

As factors which aggravate the drainage property, low drainage performance of the channel of the belt itself, low drainage performance due to attachment of a paper residue, and a small gap of the channel due to abrasion or compressive strain of the channel while it is used are considered. Japanese Unexamined Patent Publication No. 2002-220789 focused on such problems. The above document discloses a shoe press belt in which a surface of a wet web side layer is made hydrophobic with a fluoro resin, a silicone resin and the like.

According to a constitution disclosed in the above document, the drainage performance of the belt itself can be improved by forming the surface of the belt with the hydrophobic material. However, prevention of attachment of the paper residue cannot be improved. In addition, as disclosed in the above document, when the surface of the wet web side layer is formed of the hydrophobic material, the above general required characteristics, that is, the strength, the crack resistance, the flexibility and the impermeability could be inferior to the case polyurethane is used, so that many issues to be solved are left in practical utilization.

The inventor of the present invention focused on surface roughness of a wall of the drainage channel as a factor to improve squeezing performance of the paper making elastic belt. Those skilled in the art have not focused on the surface roughness of the drainage channel so far.

Since a channel width is as small as 0.6 to 1.5 mm when the channel is cut and shaped in the elastic belt, a cooling process with cooling water at the processing part becomes unstable or a swarf cannot be smoothly discharged, so that the conventional surface roughness of the channel wall is 3 to 4 μm as hard as possible. The inventor of the present invention found that when the surface roughness of the channel wall became a predetermined value or more, resistance to water flow became great or paper residue was likely to be attached, so that the squeezing performance of the elastic belt was lowered.

SUMMARY OF THE INVENTION

It is an object of the present invention to provide a paper making elastic belt which can provide preferable squeezing performance.

The present invention is characterized in that in a paper making elastic belt having a drainage channel in its surface, a surface roughness of a wall of the drainage channel is not more than 2.0 μm in an arithmetic average roughness (Ra) defined by Japanese Industrial Standards (JIS-B0601).

When the surface roughness of the wall of the drainage channel is made to be not more than 2.0 μm, resistance to a water flow can be small and attachment of a paper residue can be considerably reduced, so that preferable squeezing performance can be implemented.

According to one embodiment of the present invention, the drainage channel has a bottom which is curved downward. When the drainage channel has the above constitution, a crack of the channel caused from a bottom part of the channel can be prevented from being generated.

For example, a width of the channel is 0.6 to 1.5 mm.

DESCRIPTION OF THE PREFERRED EMBODIMENTS

Figure 1:
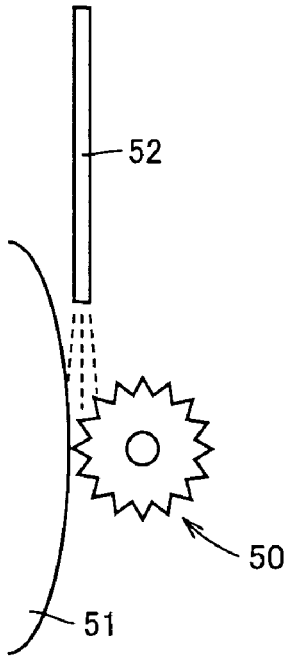
FIG. 1 is a view showing a state in which a channel is formed in a paper making elastic belt with a rotation cutting tool.

FIG. 1 shows a state in which a channel is formed in an elastic belt 51 with a rotation cutting tool 50. As shown in FIG. 1, a cooling agent is sprayed from a cooling agent supply tube 52 to the elastic belt 51 and the rotation cutting tool 50 at a processing part when the channel is formed. Thus, since the channel is formed while its processing part is cooled, the elastic belt 51 is prevented from being melted due to frictional heat, so that finally provided configuration and dimension of the channel becomes stable and surface roughness of the channel is improved.

Figure 2:
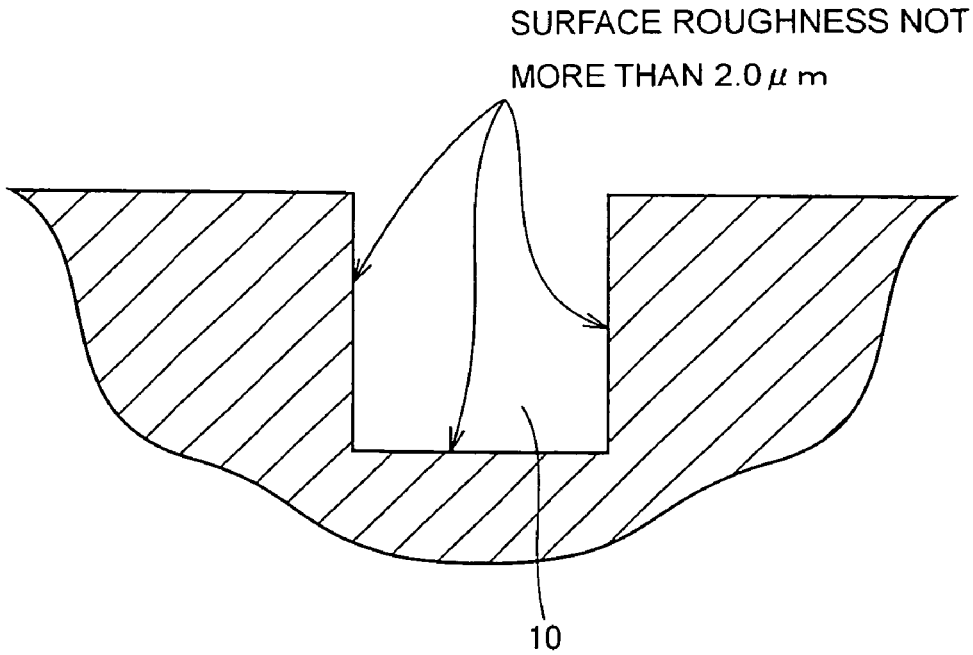
FIG. 2 is a sectional view showing a drainage channel of the paper making elastic belt according to one embodiment of the present invention.

FIG. 2 shows a drainage channel of a paper making elastic belt according to one embodiment of the present invention. According to the illustrated drainage channel 10, a sectional configuration is rectangular and surface roughness of its wall (Ra defined by Japanese Industrial Standards) is not more than 2.0 μm.

Figure 3:
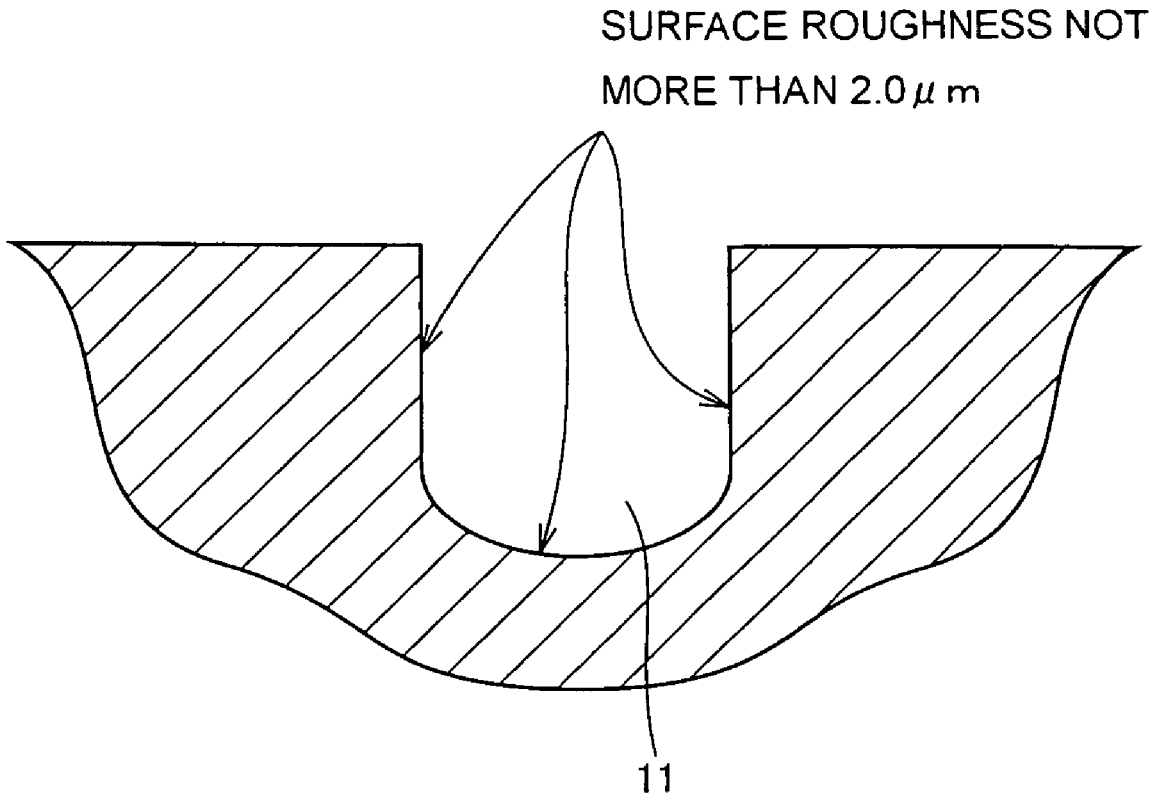
FIG. 3 is a sectional view showing a drainage channel of the paper making elastic belt according to another embodiment of the present invention.
Figure 4:
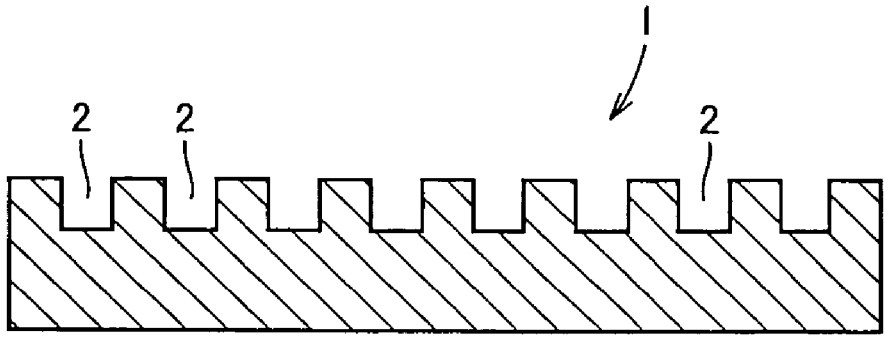
FIG. 4 is a sectional view showing a paper making elastic belt having drainage channels.

FIG. 3 shows a drainage channel of a paper making elastic belt according to another embodiment of the present invention. According to the illustrated drainage channel 11, its bottom configuration is curved downward and surface roughness of its wall is not more than 2.0 μm. According to the drainage channel 11 having such curved bottom configuration in this embodiment, a crack caused from a corner part of the bottom can be especially prevented from being generated.

As a method of making the surface roughness of the wall be not more than 2.0 μm, although either one of the following can be used, it is very effective to use both of them.

(1) A temperature of cooling liquid sprayed to the processing part is to be lowered. When the temperature of the cooling liquid is low, since frictional heat can be effectively prevented from being generated, the elastic belt can be prevented from being melted. A preferable temperature of the cooling liquid is not more than 10° C.

(2) A pressure of the cooling liquid sprayed to the processing part is to be raised. When the cooling liquid is sprayed at high pressure, since a swarf can blow off, it is prevented from being attached on the wall surface of the channel. A preferable pressure of the cooling liquid is 10 to 50 kg/cm$^2$.

The inventor of the present invention performed the following test in order to examine a relation between a temperature of the cooling liquid and a surface roughness of the channel wall. In addition, the inventor used an electrodeposition stone and a metal saw as a slitter for the channel processing.

Processing conditions were as follows.

Rotation speed of a base material to be processed: 3 rpm

Rotation speed of the slitter: 3000 rpm

Cooling agent: Pressured water of 10 to 50 kg/cm$^2$.

A result of the processing test is shown in the following table 1.

TABLE 1

Comparison of surface roughness of channel wall

| | Cooling Liquid temperature | | | |
|---|---|---|---|---|
| Kind of slitter | 5° C. | 10° C. | 20° C. | 30° C. |
| Electrodeposition stone | 1.5 μm | 2 μm | 4 μm | 4 μm |
| Metal saw | 0.7 μm | 1 μm | 3 μm | 3 μm |

The surface roughness was measured by a surface texture and contour measuring instrument (SURFCOM 733A produced by Tokyo Seimitsu Co., Ltd.). As can be clear from the result in the table 1, it can be confirmed that when the temperature of the cooling liquid is not more than 10° C., the surface roughness of the channel wall is not more than 2 μm.

The inventor of the present invention used each of elastic belts having surface roughness 0.7 μm, 2 μm, 3 μm and 4 μm for shoe press of the newspaper and gave visual recognition to a stain level of the channel wall surface. The result is shown in the following table 2.

TABLE 2

| Surface roughness of Channel wall | Stain level |
|---|---|
| 0.7 μm | Almost nothing |
| 2 μm | A few stain |
| 3 μm | Partially conspicuous stain (conspicuous in the vicinity of corner of channel bottom) |
| 4 μm | Conspicuous stain (entire wall surface of channel) |

Although the embodiments of the present invention have been described with reference to the drawings in the above, the present invention is not limited to the above-illustrated embodiments. Various kinds of modifications and variations may be added to the illustrated embodiments within the same or equal scope of the present invention.

The present invention can be advantageously applied to the paper making elastic belt having the drainage channels.

What is claimed is:

1. A paper making elastic belt comprising:

a belt body including a surface having a drainage channel therein, wherein said drainage channel is defined by a wall with a surface roughness that is not more than 2.0 μm in arithmetic average roughness (Ra), and wherein said width of said drainage channel is at least 0.6 mm.

2. The paper making elastic belt according to claim 1, wherein said drainage channel has a bottom curved downward.

3. The paper making elastic belt according to claim 1, wherein said width of said drainage channel is not more than 1.5 mm.

4. A method of making a paper making elastic belt having a drainage channel, said method comprising:

cutting a drainage channel in a surface of a belt body using a cutting tool; and cooling the drainage channel as the drainage channel is formed using the cutting tool, wherein the drainage channel is defined by a wall with a surface roughness that is not more than 2.0 μm in arithmetic average roughness (Ra), and wherein the drainage channel is formed to have a width of at least 0.6 mm.

5. The method according to claim 4, wherein the width of the drainage channel is formed to be not more than 1.5 mm.

6. The method according to claim 4, wherein the drainage channel is formed to have a bottom curved downward.

7. The method according to claim 4, wherein the cutting tool is a rotating cutting tool.

8. The method according to claim 4, wherein the drainage channel is cooled by spraying a cooling agent onto the drainage channel as the drainage channel is formed using the cutting tool.

9. The method according to claim 8, wherein the cooling agent is a cooling liquid at a temperature of not more than 10° C.

10. The method according to claim 8, wherein the cooling agent is a cooling liquid, and wherein the cooling liquid is sprayed onto the drainage channel at a pressure of 10 to 50 kg/cm$^2$.

11. The method according to claim 10, wherein the cooling liquid at a temperature of not more than 10° C.

12. The method according to claim 4, wherein the cutting of the drainage channel in the surface of the belt body is performed using a slitter including a rotating metal saw as the cutting tool, and an electrodeposition stone.

13. The method according to claim 4, wherein the drainage channel is cooled by spraying a cooling agent onto the drainage channel as the drainage channel is formed using the cutting tool, and wherein the cooling agent is a cooling liquid at a temperature of not more than 10° C.

14. The method according to claim 4, wherein the drainage channel is cooled by spraying a cooling agent onto the drainage channel as the drainage channel is formed using the cutting tool, wherein the cooling agent is a cooling liquid, and wherein the cooling liquid is sprayed onto the drainage channel at a pressure of 10 to 50 kg/cm$^2$.

15. The method according to claim 14, wherein the cooling liquid at a temperature of not more than 10° C.

16. The method according to claim 5, wherein the drainage channel is cooled by spraying a cooling agent onto the drainage channel as the drainage channel is formed using the cutting tool, and wherein the cooling agent is a cooling liquid at a temperature of not more than 10° C.

17. The method according to claim 5, wherein the drainage channel is cooled by spraying a cooling agent onto the drainage channel as the drainage channel is formed using the cutting tool, wherein the cooling agent is a cooling liquid, and wherein the cooling liquid is sprayed onto the drainage channel at a pressure of 10 to 50 $kg/cm^2$.

18. The method according to claim 17, wherein the cooling liquid at a temperature of not more than 10° C.

* * * * *